US010767359B2

(12) United States Patent
Saito et al.

(10) Patent No.: US 10,767,359 B2
(45) Date of Patent: Sep. 8, 2020

(54) FLUSH TOILET

(71) Applicant: PANASONIC INTELLECTUAL PROPERTY MANAGEMENT CO., LTD., Osaka (JP)

(72) Inventors: Takahisa Saito, Shiga (JP); Masahide Shiratani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 97 days.

(21) Appl. No.: 15/028,726

(22) PCT Filed: Oct. 8, 2014

(86) PCT No.: PCT/JP2014/005123
§ 371 (c)(1),
(2) Date: Apr. 12, 2016

(87) PCT Pub. No.: WO2015/072068
PCT Pub. Date: May 21, 2015

(65) Prior Publication Data

US 2016/0273204 A1 Sep. 22, 2016

(30) Foreign Application Priority Data

Nov. 18, 2013 (JP) ..... 2013-238059

(51) Int. Cl.
*E03D 11/02* (2006.01)
*A47K 13/24* (2006.01)
(Continued)

(52) U.S. Cl.
CPC ..... *E03D 11/02* (2013.01); *A47K 13/00* (2013.01); *A47K 13/02* (2013.01); *A47K 13/24* (2013.01); *A47K 13/305* (2013.01); *A47K 13/08* (2013.01)

(58) Field of Classification Search
CPC ..... A47K 13/00; A47K 13/02; A47K 13/08; A47K 13/24; A47K 13/305; E03D 11/02; E03D 9/00; E03D 11/13
(Continued)

(56) References Cited

U.S. PATENT DOCUMENTS 964,533 A * 7/1910 McDonald ..... A47K 13/00 4/237
1,050,283 A * 1/1913 Mayo ..... A47K 13/302 4/233
(Continued)

FOREIGN PATENT DOCUMENTS

CN 202787458 3/2013
DE 2012568 11/1971
(Continued)

OTHER PUBLICATIONS

DE 2012568 Translation.*
(Continued)

*Primary Examiner* — David P Agnaw
*Assistant Examiner* — William R Klotz
(74) *Attorney, Agent, or Firm* — Greenblum & Bernstein, P.L.C.

(57) ABSTRACT

A flush toilet enabling easy cleaning besides capable of preventing dirty water from flowing out is provided. In the flush toilet, a toilet seat is placed on a rim of a toilet body with the toilet seat free to open and close on a pivot axis on a side of a rear end thereof. A projection rib for preventing dirty water from flowing out is formed on a front upper face of the rim so that it protrudes from an outer periphery of the rim. The projection rib is provided so that it is outside a front periphery of the toilet seat when the toilet seat is in closing state.

5 Claims, 3 Drawing Sheets

(51) Int. Cl.

| | |
|---|---|
| ***A47K 13/00*** | (2006.01) |
| ***A47K 13/02*** | (2006.01) |
| ***A47K 13/30*** | (2006.01) |
| ***A47K 13/08*** | (2006.01) |

(58) Field of Classification Search
USPC ..... 4/300.3, DIG. 5, 237, 420
See application file for complete search history.

(56) References Cited

U.S. PATENT DOCUMENTS

| | | | | |
|---|---|---|---|---|
| 5,625,905 | A * | 5/1997 | Woods | E03D 9/00 4/300.3 |
| 6,119,282 | A * | 9/2000 | Serbin | A47K 13/24 4/300.3 |
| 8,266,731 | B2 * | 9/2012 | Marra | A47K 13/08 4/245.2 |
| 2009/0260142 | A1 * | 10/2009 | Fahmie | A47K 13/24 4/237 |
| 2010/0263115 | A1 * | 10/2010 | Thom | E03D 9/00 4/300.3 |
| 2012/0066824 | A1 * | 3/2012 | DeZarn | A47K 13/08 4/300.3 |
| 2014/0201895 | A1 * | 7/2014 | Murphy | A47K 13/00 4/420 |

FOREIGN PATENT DOCUMENTS

| | | | | |
|---|---|---|---|---|
| DE | 2012568 | A1 * | 11/1971 | E03D 11/02 |
| DE | 299 08 960 | | 11/1999 | |
| JP | 50-78031 | | 7/1975 | |
| JP | 07-17200 | | 3/1995 | |
| JP | 9-165808 | | 6/1997 | |
| JP | 2002-322720 | | 11/2002 | |
| JP | 2005-177095 | | 7/2005 | |
| JP | 3125579 | | 9/2006 | |
| JP | 2007-191909 | | 8/2007 | |
| JP | 3136339 | | 10/2007 | |
| JP | 2008-291608 | | 12/2008 | |
| JP | 2011-208416 | | 10/2011 | |
| JP | 2011208416 | A * | 10/2011 | |

OTHER PUBLICATIONS

JP 2011208416 Translation.*
Extended European Search Report for EP Appl. No. 14862502.3 dated Aug. 5, 2016.
International Search Report, with English-language translation thereof, for PCT/JP2014/005123 dated Jan. 13, 2015.
Official Action, along with English-language translation thereof, in CN Appl. No. 201480054885.1 dated Mar. 9, 2017.

* cited by examiner

FLUSH TOILET

TECHNICAL FIELD

The invention relates to flush toilets and, more particularly, to a flush toilet configured so that a toilet seat is placed on a rim of a toilet body with the toilet seat free to open and close.

BACKGROUND ART

There is known a flush toilet in which a toilet seat is placed on a rim of a toilet body with the toilet seat free to open and close on a pivot axis that is on a side of a rear end thereof, and in which a toilet seat cover is placed so as to cover the toilet seat with the toilet seat cover free to open and close on the same pivot axis as that of the toilet seat or another pivot axis.

In such conventional flush toilets, there are provided various prevention methods for preventing human liquid waste in sitting position or flush water causing dirt from flowing out from a gap between a front upper face of a rim of a toilet body and a front lower face of a toilet seat. For example, JP Pub No. 2007-191909 (hereinafter called "Document 1") discloses that a projection rib for preventing dirty water from flowing out is formed on the front upper face of the rim of the toilet body along an outer peripheral edge thereof and that a groove configured so that the projection rib is fit into the groove when the toilet seat is in closing state is formed in a side of the lower face of the toilet seat. The groove is provided therein with a soft packing member adapted to be in contact with the projection rib.

Though the prior art described in Document 1 can prevent dirty water (liquid waste and flush water) from flowing out, the groove becomes unclean because the dirty water is accumulated into the groove in the side of the lower face of the toilet seat. This requires frequent cleaning of the groove. Moreover, the cleaning of the groove is not easy.

SUMMARY OF INVENTION

The present invention has been achieved in view of the above circumstances, and an object thereof is to provide a flush toilet enabling easy cleaning besides capable of preventing dirty water from flowing out as a result of adequate setting of a positional relation between a projection rib for preventing dirty water from flowing out and a toilet seat when the projection rib is formed in a side of a front upper face of a rim of a toilet body.

In order to solve the problem, the present invention is for a flush toilet, configured so that a toilet seat is placed on a rim of a toilet body with the toilet seat free to open and close on a pivot axis that is on a side of a rear end thereof. A projection rib for preventing dirty water from flowing out is formed on a front upper face of the rim so that it protrudes from an outer periphery of the rim. The projection rib is provided so that it is outside a front periphery of the toilet seat when the toilet seat is in closing state.

The flush toilet according to the present invention can prevent dirty water from flowing out from a gap between the front upper face of the rim and a front lower face of the toilet seat, and achieve excellent effect on practicability without requiring onerous cleaning.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS

An embodiment of the present invention is hereinafter explained with reference to the drawings.

Figure 1:
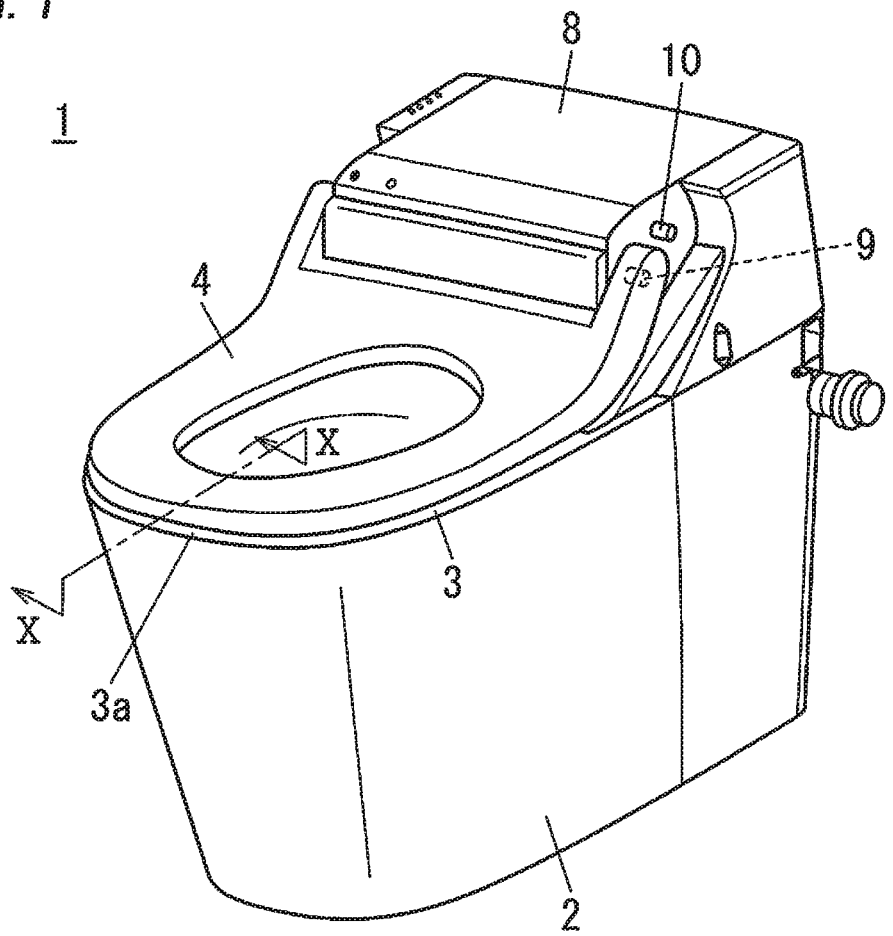
FIG. 1 is a front right perspective view of a flush toilet in accordance with an embodiment of the present invention.
Figure 2:
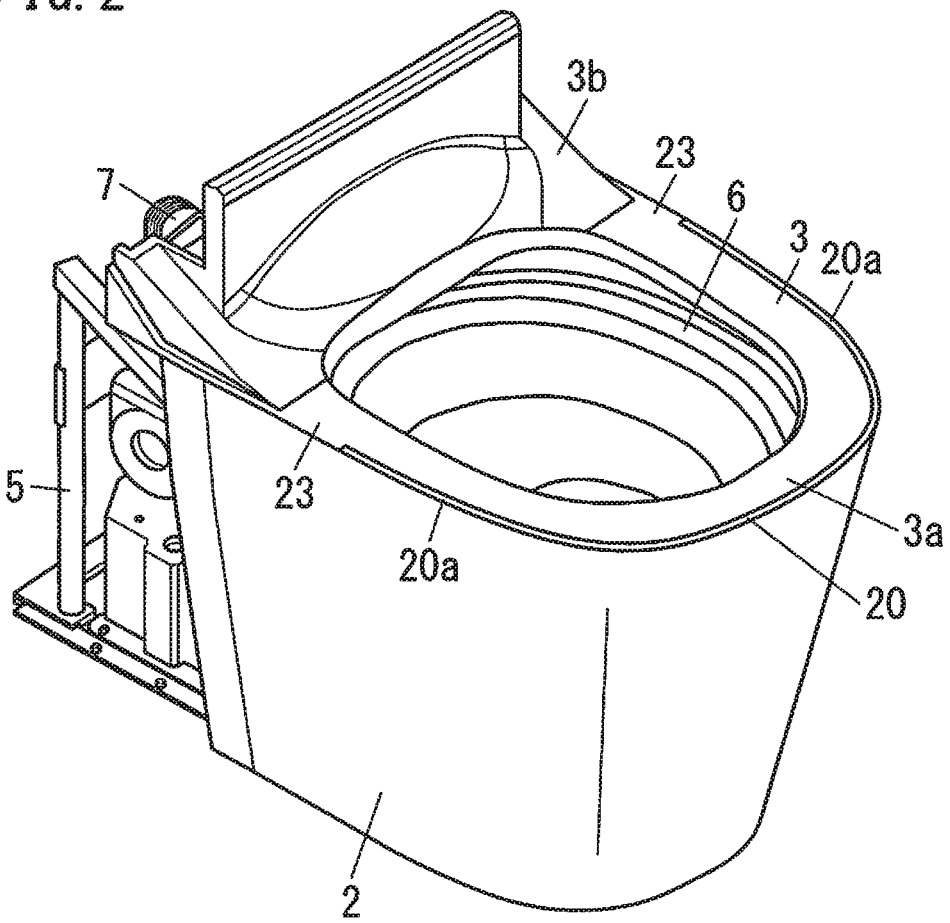
FIG. 2 is a front left perspective view of the flush toilet with a toilet seat and the like removed from the flush toilet.

FIGS. 1 and 2 show a whole configuration of a flush toilet 1 in accordance with an embodiment of the present invention. The flush toilet 1 includes a toilet body 2, a toilet seat 4 that is placed on a rim 3 of the toilet body 2 with the toilet seat free to open and close the rim, and a toilet seat cover (not shown) that is provided so that the toilet seat cover is free to open and close so as to cover the toilet seat 4.

The toilet body 2 is formed of synthetic resin components that are combined with and supported by a metal frame 5. The toilet body 2 has a toilet bowl opening 6 formed in a front part thereof and the rim 3 integrally formed with the toilet bowl opening 6 on the whole periphery of the toilet bowl opening. Apparatus 7 such as a device configured to cleanse human anal and genital is provided at a rear part of the toilet body 2, to which a rear cover 8 covering the apparatus 7 is attached. The toilet seat 4 and the toilet seat cover are attached to right and left sides of the rear cover 8 with the toilet seat and the toilet seat cover free to open and close on respective pivot axes 9 and 10.

Figure 3:
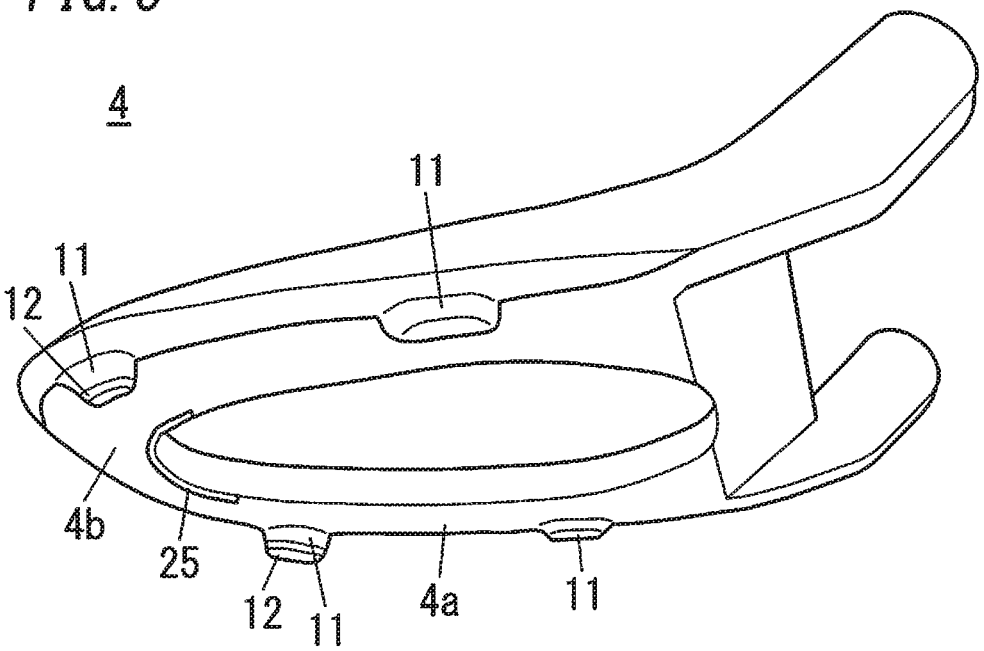
FIG. 3 is a lower perspective view of the toilet seat of the flush toilet.

Each of the toilet seat 4 and the toilet seat cover is formed of synthetic resin. The toilet seat 4 has a built-in heater (not shown) and are integrally formed with four legs 11, 11, . . . that are on right and left sides of a lower face 4*a* of the toilet seat 4 and that are two each on either side, as shown in FIG. 3. Protectors 12 that are formed of elastic material such as rubber are provided for two legs 11 and 11, on a front side, of the four legs.

Figure 4:
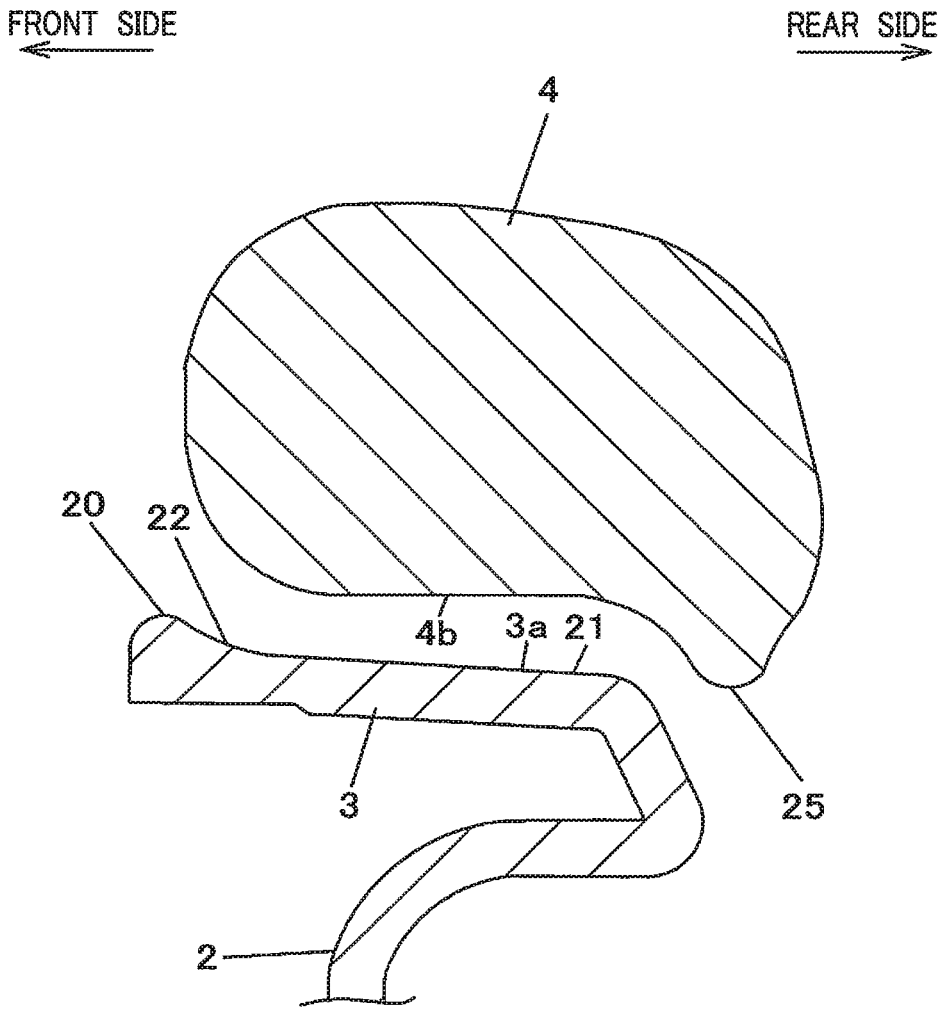
FIG. 4 is an enlarged sectional view taken along an X-X line in FIG. 1.

As shown in FIGS. 2 and 4, a projection rib 20 for preventing dirty water from flowing out is integrally formed on a front upper face 3*a* of the rim 3 so that it protrudes upward from an outer periphery of the rim. The projection rib 20 is provided so that it is outside a front periphery of the toilet seat 4 when the toilet seat 4 is in closing state. The projection rib 20 is combined smoothly with a flat area 21 of the front upper face 3*a* of the rim 3 via a curved face 22. A downward slope is formed from the flat area 21 of the front upper face 3*a* of the rim 3 so as to incline into the toilet body 2.

The projection rib 20 further has two right and left extension parts 20*a* and 20*a* that are elongated from the front upper face 3*a* of the rim 3 to the proximity of a rear part 3*b* of the rim 3 along the outer periphery of the rim 3. Lower step parts 23 are formed between tips of the extension parts 20*a* and 20*a* of the projection rib 20 and the rear part 3*b* of the rim 3 so that the lower step parts become lower than the projection rib 20 and the rear part 3*b* of the rim 3.

On the other hand, the toilet seat 4 is integrally formed with a downward projection part 25 that protrudes inside an inner periphery of the rim 3. The projection part 25 is provided so that a lower end thereof is below the projection rib 20 of the front upper face 3*a* of the rim 3 and an inner edge of the flat area 21 when the toilet seat 4 is in closing state.

Thus, in the flush toilet 1, the projection rib 20 for preventing dirty water from flowing out is formed on the front upper face 3*a* of the rim 3 of the toilet body 2 so that it protrudes from the outer periphery of the rim. The projection rib 20 is provided so that it is outside the front periphery of the toilet seat 4 when the toilet seat 4 is in closing state. As a result, dirty water can be prevented from flowing out from a gap between the front upper face 3*a* of the rim 3 and a front lower face 4*b* of the toilet seat 4. In addition, cleaning thereof can be made easier and excellent effect on practicability can be achieved.

Since the projection rib 20 is combined smoothly with the flat area 21 of the front upper face 3*a* of the rim 3 via the curved face 22 in particular, the embodiment can prevent dirt from being accumulated between the projection rib 20 and the flat area 21, and further facilitate cleaning. A range of the projection rib 20 or a range of the slope from the flat area 21 may be limited to only the front upper face 3*a*, or voluntarily set in a range of the outer periphery from the front upper face 3*a* to the rear part 3*b* of the rim 3.

Since the downward slope is formed so as to incline into the toilet body 2 from the flat area 21 of the front upper face 3*a* of the rim 3, even if dirty water is accumulated on the flat area 21, the dirty water is to drop down into the toilet body 2 along the slope from the flat area 21. Thus, much dirty water can be prevented from being accumulated on the flat area 21, and accordingly dirt on the flat area 21 can be suppressed, thereby further facilitating cleaning.

Since the toilet seat 4 is integrally formed with the projection part 25 that protrudes inside the inner periphery of the rim 3 when the toilet seat 4 is in closing state, dirty water can be surely prevented from flowing out from the gap between the front upper face 3*a* of the rim 3 and the front lower face 4*b* of the toilet seat 4. The projection part 25 is provided so that a lower end thereof is below the inner edge of the flat area 21 when the toilet seat 4 is in closing state, and accordingly dirt water can be further prevented from flowing out.

In addition, the projection rib 20 is elongated from the front upper face 3*a* of the rim 3 to the proximity of the rear part 3*b* of the rim 3 along the outer periphery of the rim 3. Accordingly, not only dirty water can be prevented from flowing out from the gap between the front upper face 3*a* of the rim 3 and the front lower face 4*b* of the toilet seat 4, but also dirty water can be prevented from flowing out from gaps between an upper face, except for the front upper face 3*a*, of the rim 3 and the front lower face 4*b* of the toilet seat 4. Moreover, the lower step parts 23 are formed between the tips of the extension parts 20*a* and 20*a* of the projection rib 20 and the rear part 3*b* of the rim 3 so that the lower step parts become lower than the projection rib 20 and the rear part 3*b* of the rim 3. Therefore, when water such as dirty water on the upper face of the rim 3 is accumulated by being held back by the projection rib 20, the water such as dirty water can be flowed outside the flush toilet 1 from the lower step parts 23. As a result, the water such as dirty water can be prevented from reaching electrical components provided in the rear part of the toilet body 2, and a bad influence thereon can be suppressed. In this case, the water such as dirty water flowing outside the flush toilet 1 concentrates in parts flowing from the lower step parts 23, and accordingly cleaning can be made easier in comparison with the case where no projection rib 20 is provided.

Note that the present invention is not limited to the abovementioned embodiment but can include other various embodiments. For example, in the abovementioned embodiment, the toilet seat 4 and the toilet seat cover are attached to the right and left sides of the rear cover 8, which is on a side of the rear part of the toilet body 2, with the toilet seat and the toilet seat cover free to open and close on individual pivot axes 9 and 10. However, the present invention is not limited thereto indeed. The invention can be applied to, for example, the case where the toilet seat 4 and the toilet seat cover are attached to the right and left sides of the rear cover 8 of the toilet body 2 with the toilet seat and the toilet seat cover free to open and close on an identical pivot axis. The same effect can be achieved.

In the abovementioned embodiment, the toilet body 2 is formed of the synthetic resin components that are combined with and supported by the metal frame 5. However, the present invention is not limited thereto. The invention can be applied to the case where the toilet body 2 is formed of other materials such as ceramic material.

What is claimed is:

1. A flush toilet comprising:

a toilet body including a rim; and a toilet seat that is configured to be placed on the rim, wherein the toilet seat is configured to freely open and close about a pivot axis that is disposed on a side of a rear end of the toilet seat, the toilet seat includes a lower face comprising a leg, the rim includes a projection rib for preventing dirty water from flowing out, a front upper face of the rim includes a flat area and a curved face, the curved face connects the projection rib and the flat area, the toilet seat includes an outermost peripheral edge point provided at a front side of the flush toilet, the curved face is provided directly under the outermost peripheral edge point of the toilet seat when the toilet seat is closed, the leg is configured to provide a space between the front upper face of the rim and a front lower face of the toilet seat when the toilet seat is closed, the projection rib is integral with and protrudes upwardly from an outer periphery of the front upper face of the rim, the projection rib is provided outside of and spaced apart from the outermost peripheral edge point of the toilet seat when the toilet seat is closed, and an upper end of the projection rib is level in a vertical direction with an upper end of a gap between the front upper face of the rim and the front lower face of the toilet seat when the toilet seat is closed.

2. The flush toilet of claim 1, wherein the flat area slopes downward so as to decline towards an inside of the toilet body.

3. The flush toilet of claim 1, wherein the toilet seat includes a projection part that is integral with and protrudes downwardly from an inner periphery of the front lower face of the toilet seat, and the projection part protrudes inside an inner periphery of the rim when the toilet seat is closed.

4. The flush toilet of claim 1, wherein the toilet body includes a toilet bowl opening, and a whole periphery of the toilet bowl opening is integral with the rim, the projection rib includes extension parts that are elongated from the front upper face of the rim towards a rear part of the rim along an outer periphery of an upper face of the rim, the rear part of the rim being disposed at a backside of the toilet bowl opening, and a rear upper face of the rim includes lower step parts provided between the extension parts of the projection rib and the rear part of the rim such that the lower step parts are disposed lower than the projection rib and the rear part of the rim.

5. The flush toilet of claim 1, wherein the curved face curves upward from the flat area to the projection rib in a front-rear side direction of the flush toilet.

* * * * *